US009714400B2

(12) United States Patent
He et al.

(10) Patent No.: US 9,714,400 B2
(45) Date of Patent: Jul. 25, 2017

(54) FABRIC SOFTENER

(71) Applicant: RHODIA OPERATIONS, Paris (FR)

(72) Inventors: Lin He, Singapore (SG); Hai Zhou Zhang, Singapore (SG)

(73) Assignee: Rhodia Operations, Paris (FR)

( * ) Notice: Subject to any disclaimer, the term of this patent is extended or adjusted under 35 U.S.C. 154(b) by 0 days.

(21) Appl. No.: 14/780,273

(22) PCT Filed: Mar. 25, 2014

(86) PCT No.: PCT/EP2014/055899

§ 371 (c)(1),
(2) Date: Sep. 25, 2015

(87) PCT Pub. No.: WO2014/154654

PCT Pub. Date: Oct. 2, 2014

(65) Prior Publication Data

US 2016/0053202 A1 Feb. 25, 2016

(30) Foreign Application Priority Data

Mar. 25, 2013 (WO) ..... PCT/EP2013/056228

(51) Int. Cl.

| | |
|---|---|
| ***C11D 1/94*** | (2006.01) |
| ***C11D 3/00*** | (2006.01) |
| ***C11D 1/90*** | (2006.01) |
| ***C11D 3/20*** | (2006.01) |

(52) U.S. Cl.
CPC ..... *C11D 3/001* (2013.01); *C11D 1/90* (2013.01); *C11D 3/2013* (2013.01); *C11D 3/2079* (2013.01)

(58) Field of Classification Search
CPC ..... C11D 1/94; C11D 1/90
See application file for complete search history.

(56) References Cited

U.S. PATENT DOCUMENTS

| | | | |
|---|---|---|---|
| 3,853,770 | A | 12/1974 | Altschuler |
| 3,984,335 | A | 10/1976 | Ciko et al. |
| 4,102,825 | A | 7/1978 | Murata et al. |
| 4,360,437 | A | 11/1982 | Wolfes |
| 4,556,502 | A | 12/1985 | Blackmore et al. |
| 4,855,072 | A | 8/1989 | Trinh et al. |
| 4,919,846 | A | 4/1990 | Nakama et al. |
| 5,476,614 | A | 12/1995 | Adamy et al. |

FOREIGN PATENT DOCUMENTS

| | | | |
|---|---|---|---|
| EP | 0018039 | A1 | 10/1980 |
| EP | 0019734 | A1 | 12/1980 |
| EP | 0369500 | A2 | 5/1990 |
| EP | 0408279 | A2 | 1/1991 |
| EP | 1081269 | A1 | 3/2001 |
| EP | 1607472 | A1 | 12/2005 |
| WO | 9414935 | A1 | 7/1994 |
| WO | 9742279 | A1 | 11/1997 |
| WO | 2004044113 | A2 | 5/2004 |
| WO | 2006094309 | A2 | 9/2006 |
| WO | 2013087286 | A1 | 6/2013 |

OTHER PUBLICATIONS

"Cetyl betaine", 2012, SAA Pedia, XP002725062, URL:http://www.saapedia.org/en/saa/?type=detail&id=30, retrieved on May 27, 2015; 2 pgs.

*Primary Examiner* — John Hardee
(74) *Attorney, Agent, or Firm* — Jarrod N. Raphael

(57) ABSTRACT

The present invention concerns the use of $C_{16}$-alkyl betaine as a fabric softener, notably for fabric softening compositions. The invention also concerns a method of treating fabric which comprises the step of contacting said fabric in the rinse cycle of a fabric washing machine with an aqueous medium containing a composition as defined herein.

11 Claims, No Drawings

FABRIC SOFTENER

This application is a U.S. national stage entry under 35 U.S.C. §371 of International Patent Application No. PCT/EP2014/055899, filed Mar. 25, 2014, which claims priority to International Patent Application No. PCT/EP2013/056228, filed on Mar. 25, 2013, the whole content of each of these applications is hereby incorporated herein by reference for all purposes.

The present invention concerns the use of $C_{16}$-alkyl betaine as a fabric softener, notably for fabric softening compositions. The invention also concerns a method of treating fabric which comprises the step of contacting said fabric in the rinse cycle of a fabric washing machine with an aqueous medium containing a composition as defined herein.

PRIOR ART

The following discussion of the prior art is provided to place the invention in an appropriate technical context and enable the advantages of it to be more fully understood. It should be appreciated, however, that any discussion of the prior art throughout the specification should not be considered as an express or implied admission that such prior art is widely known or forms part of common general knowledge in the field.

Fabric care compositions deliver a number of desirable characteristics to fabrics upon treatment, including an improved fabric feel and a perception of freshness. However, in order to secure high consumer acceptance of any fabric care composition, it is essential to provide consumer-desirable product aesthetics, for example not only an appealing neat product odor and a pleasant product color, but especially an appropriate product rheology and satisfactory physical product stability.

Preferred fabric softener actives according to WO-A-02072745 are esterquats such as N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2-hydroxyethyl) N-methyl ammonium methylsulfate or 1,2-di(stearoyl-oxy)-3-trimethyl ammoniumpropane chloride.

There is an abundant bibliography on the subject of combining dialkyl substituted quaternary ammonium compounds and monoalkyl quaternary ammonium compounds, amongst which patents or patent applications EP-A-0018039, EP-A-0369500, U.S. Pat. No. 4,360,437 or U.S. Pat. No. 4,855,072 amongst many others, may be mentioned.

References describing mixtures of dialkyl substituted esterquats and monoalkyl esterquats are WO-A-9414935, WO-A-9742279, WO-A-2004044113 amongst many others.

However, quats are known as very difficult to be biodegradable and provide confirmed eco toxicity, and it exists a general trend for this industry is to switch to esterquats, which provide better biodegradability and better eco toxicity. But even ester quats provides still some disadvantages as a not so long term stability in the final product due to a degradability that imposes to keep a very low pH in order to make it more stable. Moreover, fabric turns to yellowish when they are treated repeatedly by ester quats. Ester quats are also known as cationic surfactants that can not be mixed directly with most of the anionic detergent system.

INVENTION

The present invention is based on the surprising discovery that it is possible to obtain a stable fabric softener composition that performs well on softening fabrics, which comprises a fatty alkyl betaine.

These compounds indeed appear to be sufficiently efficient and notably more efficient in term of softness, water absorbency and fluffiness, in comparison with the compounds classically used in the softening compositions such as di(palmiticcarboxyethyl) hydroxyethyl methyl ammonium methylsulfate (TEP), and Dimethyl di(hydrogenated tallow) ammonium chloride (DHT).

These compounds also provide the advantages to be translucent and transparent, more stable over time and different pH range, and provide a good compatibility with all other surfactants system.

Softening composition of the present invention comprising softener and water also provide the advantage to be homogeneous without phase separation.

The present invention then concerns a softening composition comprising at least a fabric softener compound of formula (I):

$$R^1—N^+(CH_3)_2—CH_2—COO^- \quad (I)$$

wherein $R^1$ is $C_{16}$-alkyl.

The present invention also concerns the use of a compound of formula (I) as a fabric softener, notably for fabric softening compositions.

Other characteristics, details and advantages of the invention will emerge even more fully upon reading the description which follows.

Throughout the description, including the claims, the term "comprising one" should be understood as being synonymous with the term "comprising at least one", unless otherwise specified, and "between" should be understood as being inclusive of the limits.

A fabric softener, or mixtures thereof, is an essential ingredient of the invention. Typical levels of the fabric softener within the softening compositions are 0.1% to 20% by weight, preferably from 1% to 15% by weight, more preferably from 3 to 10% by weight.

"Alkyl" as used herein means a straight chain or branched saturated aliphatic hydrocarbon. Alkyl chain may notably comprise one or several heteroatoms such as N or O. In complex structures, the chains may be branched, bridged, or cross-linked.

In a preferred embodiment of the present invention, the compound of formula (I) is cetyl betaine.

According to one embodiment of the present invention, the softening composition may also comprise a $C_{10}$-$C_{22}$ carboxylic acid and/or a $C_{10}$-$C_{22}$ alcohol.

Preferably, the $C_{10}$-$C_{22}$ carboxylic acids are chosen on the group consisting of capric acid, lauric acid, myristic acid, palmitic acid, stearic acid, arachidic acid and behenic acid.

Preferably, the $C_{10}$-$C_{22}$ alcohols are chosen on the group consisting of capryl alcohol, lauryl alcohol, myrityl alcohol, palmityl alcohol, stearyl alcohol, arachidyl alcohol and behenyl alcohol.

Weight ratio of compound of formula (I) to the $C_{10}$-$C_{22}$ carboxylic acids and/or the $C_{10}$-$C_{22}$ alcohols may be comprised between 4:1 and 50:1, preferably between 10:1 and 20:1.

For optimum phase stability of these compositions, the neat pH, measured at 20 C, may be in the range of from 3 to 7. The pH of these compositions herein can be regulated by the addition of acids such as Bronsted or Lewis ones.

Examples of suitable acids include the inorganic mineral acids, carboxylic acids, in particular the low molecular weight ($C_1$-$C_5$)-carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids. Especially preferred is citric acid.

The softening composition may also comprise other fabric softeners classically used, such as for example quaternary ammonium salts, particularly dialkyl quats or ester quats. Fabric softeners tend to be based on quaternary ammonium salts with one or two long alkyl chains, a typical compound being dipalmitoylethyl hydroxyethylmonium methosulfate. Other cationic compounds can be derived from imidazolium, substituted amine salts, or quaternary alkoxy ammonium salts. One of the most common compounds of the early formulations was dihydrogenated tallow dimethyl ammonium chloride (DHTDMAC). There are three main types of quaternary ammonium compounds used in the formulation of household fabric softeners: dialkyldimethyl ammonium compounds, diamido alkoxylated ammonium compounds, and imidazolinium compounds.

Softeners that may be used in combination with the compound of formula (I) are preferably quaternary ammonium softeners such as:

TET: Di(tallowcarboxyethyl)hydroxyethyl methyl ammonium methylsulfate

TEO: Di(oleocarboxyethyl)hydroxyethyl methyl ammonium methylsulfate,

TES: Distearyl hydroxyethyl methyl ammonium methylsulfate,

TEHT: Di(hydrogenated tallow-carboxyethyl)hydroxyethyl methyl ammonium methylsulfate, and TEP: Di(palmiticcarboxyethyl)hydroxyethyl methyl ammonium methylsulfate In referring to other optional components, without this having to be regarded as an exhaustive description of all possibilities, which, on the other hand, are well known to the person skilled in the art, the following may be mentioned:

a) other products that enhance the performance of the softening compositions, such as silicones, amine oxides, anionic surfactants, such as lauryl ether sulphate or lauryl sulphate, sulphosuccinates, amphoteric surfactants, such as amphoacetate, nonionic surfactants such as polysorbate, polyglucoside derivatives, etc, b) stabilising products, such as salts of amines having a short chain, which are quaternised or non-quaternised, for example of triethanolamine, N-methyldiethanolamine, etc., and also non-ionic surfactants, such as ethoxylated fatty alcohols, ethoxylated fatty amines, polysorbate, and ethoxylated alkyl phenols; typically used at a level of from 0 to 15% by weight of the composition, c) products that improve viscosity control, for example inorganic salts, such as calcium chloride, magnesium chloride, calcium sulphate, sodium chloride, etc.; products which can be used to reduce viscosity in concentrated compositions, such as compounds of the glycol type, such as, ethylene glycol, dipropylene glycol, polyglycols, etc.; and thickening agents for diluted compositions, for example, polymers derived from cellulose, guar gum, etc, d) components for adjusting the pH, which is preferably from 4 to 6, such as any type of inorganic and/or organic acid, for example hydrochloric, sulphuric, phosphoric, citric acid etc, e) agents that improve soil release, such as the known polymers or copolymers based on terephthalates, f) bactericidal preservative agents, g) other products such as antioxidants, colouring agents, perfumes, germicides, fungicides, anti-corrosive agents, anti-crease agents, opacifiers, optical brighteners, pearl lustre agents, etc.

The fabric softener according to the invention, may take a variety of physical forms including liquid, liquid-gel, paste-like, foam in either aqueous or non-aqueous form, powder, granular and tablet forms. For better dispersability, a preferred form of the composition is a liquid form, and in the form of an aqueous dispersion in water. When in a liquid form, the composition may also be dispensed with dispensing means such as a sprayer or aerosol dispenser.

When in a liquid form, such a fabric softener may contain from 0.1% to 20% by weight of a fabric softening agent, in the case of standard (diluted) fabric softener but may contain higher levels from up to 30% or even 40% by weight in the case of very concentrated fabric softeners. The composition will usually also contain water and other additives, which may provide the balance of the composition. Suitable liquid carriers are selected from water, organic solvents and mixtures thereof. The liquid carrier employed in the instant compositions is preferably at least primarily water due to its low cost, safety, and environmental compatibility. Mixtures of water and organic solvent may be used. Preferred organic solvents are; monohydric alcohol, such as ethanol, propanol, iso-propanol or butanol; dihydric alcohol, such as glycol; trihydric alcohols, such as glycerol, and polyhydric (polyol) alcohols.

Liquid fabric softeners are customarily prepared by melting the softening ingredients and adding the melt to hot water, with agitation to disperse the water-insoluble ingredients.

The fabric softener according to the invention can be used in a so-called rinse process, where a fabric softener as defined above, is first diluted in an aqueous rinse bath solution. Subsequently, the laundered fabrics which have been washed with a detergent liquor and optionally rinsed in a first inefficient rinse step ("inefficient" in the sense that residual detergent and/or soil may be carried over with the fabrics), are placed in the rinse solution with the diluted composition. Of course, the fabric softener may also be incorporated into the aqueous bath once the fabrics have been immersed therein. Following that step, agitation is applied to the fabrics in the rinse bath solution causing the suds to collapse, and residual soils and surfactant is to be removed. The fabrics can then be optionally wrung before drying.

Accordingly, there is provided a method for rinsing fabrics, which comprises the steps of contacting fabrics, preferably previously washed in a detergent liquor, with a softening composition or a fabric softener according to the invention. The subject-matter of the invention also includes the use of a fabric softener of the present invention to impart fabric softness to fabrics that have been washed in a high suds detergent solution, while providing in the rinse a reduction of suds or foaming and without the creation of undesirable flocs.

The present invention also concerns a method for softening a fabric comprising contacting a softening composition of the invention during a rinse cycle of a fabric washing machine with an aqueous medium comprising said softening composition.

This rinse process may be performed manually in basin or bucket, in a non-automated washing machine, or in an automated washing machine. When hand washing is performed, the laundered fabrics are removed from the detergent liquor and wrung out. The fabric softener of the present invention may be then added to fresh water and the fabrics are then, directly or after an optional inefficient first rinse step, rinsed in the water containing the composition according to the conventional rinsing habit. The fabrics are then dried using conventional means.

The invention is further illustrated in the following non limiting examples.

EXPERIMENTAL PART

Material information:

Cetyl betaine (CB)

Cocoamidopropyl dimethyl betaine (CAPB)

Di(hydrogenated tallow) dimethyl ammonium chloride (DHT)

Di(palmiticcarboxyethyl) hydroxyethyl methyl ammonium methylsulfate (TEP)

Fabrics that are tested in the experimental part are the following:

Broadcloth: 100% cotton fiber content/woven/Used for rewet method for water absorbency study Terry cloth: 100% cotton fiber content/looped file construction/Used for all of the other evaluation methods I. Pre Treatment, Drying and Softener Treatment Procedure 1) Fabric Pretreatment Method Washing machine model: ELBA EWF 625

Surfactant: SLS (28% active)

Dosage of detergent: 10.0 g/10 pieces of cotton towel (0.6 kg)

Washing mode: 1 main wash, 3 rinses, empty and 1 spin

Wash temperature: 25 C

2) Drying of Fabric

All fabric will be hanging dried in humidity room (Temp @20±1.0° C. and humidity @55±3%) for overnight to let fabric dry and equilibrate efficiently before further use.

3) Softener Treatment

Dosage of softener: 1.0 wt % Softener formulation (5.0 or other active %) in 150 ppm hard water Soaking time: 30 min Temperature: 25 C Non-rinsing and hanging dry in humidity room II. Results and Properties 1) Softness Results for softness comparisons by incline method are mentioned in Table 1, the shorter bending length, the better the softness.

TABLE 1

| Softener | Bending length (mm) |
|---|---|
| CB | 29.6 |
| CAPB | 32.3 |
| DHT | 28.0 |
| TEP | 28.0 |

Incline Method:

Chinese National Standard Softener Evaluation Method GB/T 18318.1-2009 Textiles-determination of bending behavior-Part 1: Incline method.

Results for influence from the additives to the softness effect tested by the incline method, the shorter bending length, the better the softness.

TABLE 1.1

| Softener + additives | Bending length (mm) |
|---|---|
| CB:palmitic acid (weight ratio) 5:0.1 | 30.9 |
| CB:palmitic acid (weight ratio) 5:0.5 | 31.7 |
| CB:palmityl alcohol (weight ratio) 5:0.1 | 31.6 |
| CB:palmityl alcohol (weight ratio) 5:0.5 | 30.2 |
| CB | 33.6 |
| TEP | 30.9 |

When fatty acid or fatty alcohol is used as an additive for cetyl betaine, the softening effect is much improved, comparable or even better than TEP.

Results for softness comparisons by sensorial test method with 6 panelists are mentioned in Table 2.

TABLE 2

| Softener | Average Value |
|---|---|
| CB | 2.9 |
| CAPB | 1.0 |
| DHT | 4.3 |
| TEP | 4.0 |

Sensorial Test Method:

revised ASTM D5237-05 standard guide for evaluating fabric softener. Blank was set as control with softness ranking of 0, which means the hardest. Another fabric was treated with another type of softener EAQ with softness ranking of 5 as a control, which means the softest.

It appears then that OB or CB provides softness in comparison with compounds classically used in the softening compositions.

2) Water Absorbency

Results for water absorbency are mentioned in Table 3.

TABLE 3

| Softener | Water migration in height (mm) |
|---|---|
| CB | 76.0 |
| DHT | 9.0 |
| TEP | 53.5 |

Water Absorbency Ability Evaluation by Rewet Method:

revised ASTM D5237-05 standard guide for evaluating fabric softener

It appears then that CB and OB provides equivalent or higher water absorbency ability in comparison with compounds classically used in the softening compositions.

3) Fluffiness Evaluation

Results for fluffiness evaluation are mentioned in Table 4.

TABLE 4

| Softener | Flufiness (%) |
|---|---|
| CB | 28.2 |
| CAPB | 22.9 |
| DHT | 29.7 |
| TEP | 28.5 |

Softener treated fabric strips in certain size were stacked layer by layer. A light weight (100.0 g) and a heavy weight (550.0 g) were applied on top of the stacked layer of strips and the height of the stack of strips is measured after 15 seconds as T100 g and T550 g respectively. The bigger the difference of the stack height under light and heavy weight, the more fluffy the fabric strip is.

Fluffiness Rating Formulation:

$$\text{Fluffiness } \% = (T100\text{ g} - T550\text{ g})/T550\text{ g} * 100\%$$

Layer by layer method apparatus: Layer number: 15 layers/Sample Size: 50±1 mm in width and 80±1 mm in length/Light weight: 100.0 g weight standard/Heavy weight: 550.0 g weight standard.

It appears then that CB provides equivalent or higher fluffiness ability in comparison with compounds classically used in the softening compositions.

4) Dissolution Evaluation 4 formulations were made by addition of 5% by weight of betaine compound and optionally 0.5% by weight of palmityl alcohol in water. After keeping these formulations at room temperature, homogeneity of said formulations are expressed as follows:

A. Formulation containing 5% by weight of cetyl betaine: full dissolution of cetyl betaine and visual observation of a homogeneous medium.

B. Formulation containing 5% by weight of cetyl betaine and 0.5% of palmityl alcohol: full dissolution of cetyl betaine and palmityl alcohol and visual observation of a homogeneous medium.

C. Formulation containing 5% by weight of octadecyl diMe betaine: visual observation of a suspension with particles that can not be dissolved. Even with a heating of formulation up to 55° C., formulation remains heterogeneous with part in the top.

D. Formulation containing 5% by weight of octadecyl diMe betaine and 0.5% of palmityl alcohol: visual observation of a suspension with particles that can not be dissolved and a severe phase separation. Even with a heating of formulation up to 55° C., formulation remains heterogeneous with part in the top.

The invention claimed is:

1. A softening composition, comprising at least a fabric softener compound of formula (I):

$$R^1—N^+(CH_3)_2—CH_2—COO^- \quad (I)$$

wherein $R^1$ is $C_{16}$-alkyl, and a $C_{10}$-$C_{22}$ carboxylic acid, a $C_{10}$-$C_{22}$ alcohol, or mixtures thereof;

wherein the weight ratio of the fabric softener compound of formula (I) to the $C_{10}$-$C_{22}$ carboxylic acid, the $C_{10}$-$C_{22}$ alcohol, or the mixtures thereof is between 4:1 and 50:1.

2. The composition according to claim 1, wherein said composition comprises between 0.1% to 20% by weight of the fabric softener compound of formula (I).

3. The composition according to claim 1, wherein the compound of formula (I) is cetyl betaine.

4. The composition according to claim 1, wherein the $C_{10}$-$C_{22}$ carboxylic acid is selected from the group consisting of capric acid, lauric acid, myristic acid, palmitic acid, stearic acid, arachidic acid, behenic acid, and mixtures thereof.

5. The composition according to claim 1, wherein the $C_{10}$-$C_{22}$ alcohol is selected from the group consisting of capryl alcohol, lauryl alcohol, myrityl alcohol, palmityl alcohol, stearyl alcohol, arachidyl alcohol, behenyl alcohol, and mixtures thereof.

6. The composition according to claim 1, wherein the pH of the composition is in the range of from 3 to 7, measured at 20° C.

7. The softening composition according to claim 1 comprising from 1 wt. % to 15 wt. % of the fabric softener compound of formula (I).

8. The softening composition according to claim 1, wherein the weight ratio of the fabric softener compound of formula (I) to the $C_{10}$-$C_{22}$ carboxylic acid, the $C_{10}$-$C_{22}$ alcohol, or the mixtures thereof is between 10:1 and 20:1.

9. A method for rinsing fabrics, comprising contacting fabrics, optionally previously washed in a detergent liquor, with a softening composition according to claim 1.

10. A method for softening a fabric comprising contacting a softening composition according to claim 1 during a rinse cycle of a fabric washing machine with an aqueous medium comprising said softening composition.

11. A method for softening a fabric, comprising contacting the fabric with a compound of formula (I):

$$R^1—N^+(CH_3)_2—CH_2—COO^- \quad (I)$$

wherein $R^1$ is $C_{16}$-alkyl, and a $C_{10}$-$C_{22}$ carboxylic acid, a $C_{10}$-$C_{22}$ alcohol, or mixtures thereof;

wherein the weight ratio of the fabric softener compound of formula (I) to the $C_{10}$-$C_{22}$ carboxylic acid, the $C_{10}$-$C_{22}$ alcohol, or the mixtures thereof is between 4:1 and 50:1.

* * * * *